US006870314B2

(12) United States Patent
Kifune et al.

(10) Patent No.: US 6,870,314 B2
(45) Date of Patent: Mar. 22, 2005

(54) PANEL ASSEMBLY FOR PDP AND MANUFACTURING METHOD THEREOF

(75) Inventors: Motonari Kifune, Kawasaki (JP); Osamu Toyoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 170 days.

(21) Appl. No.: 10/355,023

(22) Filed: Jan. 31, 2003

(65) Prior Publication Data

US 2004/0000870 A1 Jan. 1, 2004

(30) Foreign Application Priority Data

Jun. 28, 2002 (JP) ..... 2002-191373

(51) Int. Cl.[7] ..... H01J 11/00
(52) U.S. Cl. ..... 313/582; 445/24
(58) Field of Search ..... 313/582–587, 313/505, 495; 345/60; 445/24

(56) References Cited

U.S. PATENT DOCUMENTS 5,825,128 A * 10/1998 Betsui et al. ..... 313/582
2001/0040539 A1 * 11/2001 Hashimoto ..... 345/60
2003/0011307 A1 * 1/2003 Otani et al ..... 313/582
2004/0051457 A1 * 3/2004 Kimura et al. ..... 313/586

FOREIGN PATENT DOCUMENTS

JP HEI 9-50768 2/1997

* cited by examiner

*Primary Examiner*—Vip Patel
*Assistant Examiner*—Glenn Zimmerman
(74) *Attorney, Agent, or Firm*—Staas & Halsey LLP

(57) ABSTRACT

A panel assembly for a PDP having ribs of partitioning a discharge space on a substrate includes grooves each formed between adjacent ribs. Each of the grooves has deeper groove regions to be luminous areas and shallower groove regions to be non-luminous areas. Black material layers are formed on the shallower groove regions.

9 Claims, 11 Drawing Sheets

PANEL ASSEMBLY FOR PDP AND MANUFACTURING METHOD THEREOF

CROSS-REFERENCE TO RELATED APPLICATION

This application is related to Japanese application No. 2002-191373 filed on Jun. 28, 2002, whose priority is claimed under 35 USC § 119, the disclosure of which is incorporated by reference in its entirety.

BACKGROUND OF THE INVENTION

1. Field of the Invention

The present invention relates to a panel assembly for a PDP (plasma display panel) and a manufacturing method thereof. More particularly, it relates to a panel assembly for a PDP in which ribs (barrier ribs) are formed and to a manufacturing method thereof.

2. Description of the Related Art

PDPs (plasma display panels) are self-luminous display panels wherein front and rear substrates are disposed in an opposing relation with a minute spacing provided between the substrates, the periphery sealed and an electric discharge gas filled in a discharge space defined between the substrates for performing display by using emission of light at generation of electric discharges within the discharge space.

In PDPs, ribs each of which has an elongate configuration are formed on a rear substrate. Examples of the ribs of the elongate configuration include ribs each of which has a linear or a meander configuration. A PDP in which the ribs of the linear configuration are formed is sometimes referred to as a PDP having a linear rib structure, and a PDP in which the ribs having the meander configuration are formed is sometimes referred to as a PDP having a meander rib structure. As the PDP having the meander rib structure, is known a PDP described in Japanese Unexamined Patent application No. Hei 9 (1997)-50768.

In PDPs of any construction, a space having a groove configuration defined by ribs serves as a discharge area, although not the entire discharge area emits light, but the groove-configured discharge area includes both a luminous area and a non-luminous area.

The non-luminous areas, which do not contribute emission of light, have desirably a black color so as to improve the contrast in display. Various methods have been proposed as a method for making the non-luminous areas black. Those methods include a method for bonding black films to areas of the front substrate corresponding to the non-luminous areas, a method for forming black material films in such areas and the like.

However, any method needs strict alignment between the front and rear substrates to dispose them in an opposing relation. Therefore, a technique has been demanded which ensures that the non-luminous areas are made black.

SUMMARY OF THE INVENTION

The present invention has been made under these circumstances, and it is an object of the present invention to form black material layers in non-luminous areas by forming deeper groove regions to be the luminous areas and shallower groove regions to be the non-luminous areas in the grooves between the ribs; and transferring a black paste only to the shallower groove regions, thereby improving the contrast in display.

The present invention provides a panel assembly for a PDP having ribs of partitioning a discharge space on a substrate, comprising: grooves each formed between adjacent ribs, each of the grooves having deeper groove regions to be luminous areas and shallower groove regions to be non-luminous areas; and black material layers formed on the shallower groove regions.

According to the present invention, the black material layers are formed in the shallower groove regions to be the non-luminous areas on the substrate. Therefore, when the substrate is used as, for example, a rear substrate and opposed to a front substrate for producing a PDP, the black material layers can absorb external light to thereby improve the contrast in display of the PDP. Further, the black material layers are accurately formed in the regions to be the non-luminous areas to eliminate the need for strict alignment between the front and rear substrates, which may possibly arise if the black material layers are formed on the front substrate for example.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
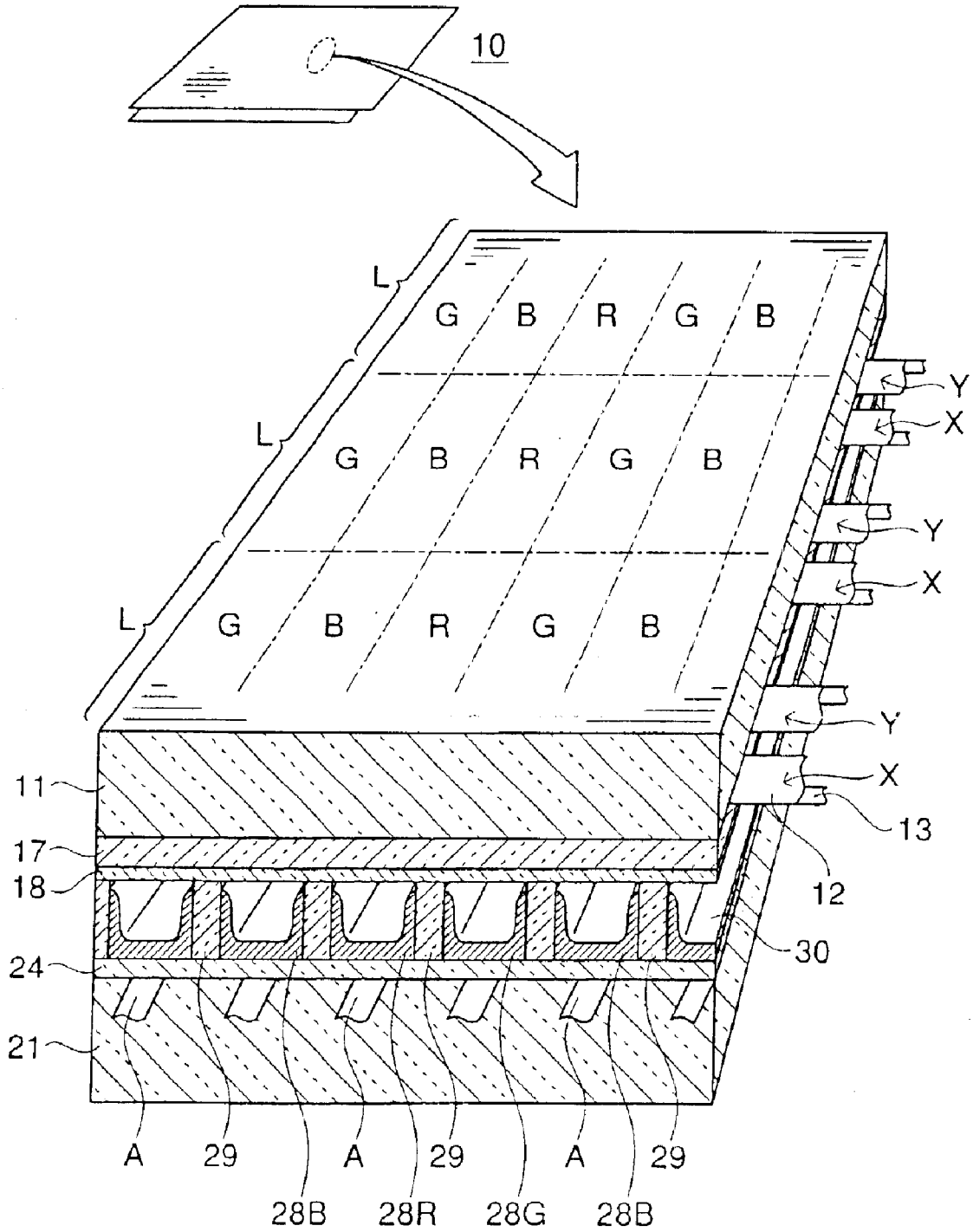
FIG. 1 is a an explanatory perspective view illustrating the construction of a PDP according to Embodiment 1 of the present invention.

In the present invention, examples of the substrate includes a glass, quartz and ceramic substrate, and a substrate on which a desired component such as an electrode, an insulating film, a dielectric layer, a protective film or the like are formed.

As a discharge gas to be filled in the discharge space defined between the substrates, may be used Ne, Xe or the like. The discharge gas may be made up by Ne: 96% and Xe: 4%, for example.

The ribs each may have any configuration such as a stripe or meander configuration if they are formed to partition the discharge space on the substrate. The ribs can be formed by sand blasting, printing, photoetching or the like known in the art. The ribs may be formed by digging grooves in, for example, a glass plate as the substrate via a mask through sand blasting. Alternatively, the ribs may be formed by applying a glass paste including a low-melting frit, a binder resin, a solvent and the like onto the substrate; drying the glass paste; cutting through sand blasting; and firing the remaining glass paste. In this case, in place of cutting through sand blasting, it is also possible to use a glass paste including a photosensitive resin as the binder resin, and expose to light and develop it via a mask, followed by firing it, thereby forming the ribs.

In the present invention, for forming the ribs, the deeper groove regions to be luminous areas and the shallower groove regions to be the non-luminous areas are formed in the grooves between the ribs, and the black material layers are formed in the shallower groove regions to be the non-luminous areas.

In order to form the deeper groove regions and the shallower groove regions in the grooves between the ribs, resist may be placed on regions corresponding to the shallower groove regions when the ribs are formed by sand blasting for example. Further, for forming the ribs by sand blasting, the grooves may be widened in the deeper groove regions and narrowed in the shallower groove regions so as to reduce the amount of sand particles to enter the narrower groove regions, thereby forming both the deeper groove regions and the shallower groove regions in the grooves between the ribs.

The ribs each may have a stripe configuration such that the deeper groove regions to be the luminous areas and the shallower groove regions to be the non-luminous areas are formed alternately in the grooves between the ribs. Alternatively, the ribs each may have a meander configuration such that the deeper groove regions to be the luminous areas and the shallower groove regions to be the non-luminous areas are formed alternately in the grooves between the ribs.

The ribs may be formed by digging the grooves in a plane substrate.

The black material layers are formed in the shallower groove regions to be the non-luminous areas. The black material layers can be formed by using a black pigment, a binder resin, an organic solvent and the like known in the art. For example, the binder resin and the organic solvent are added to the black pigment to prepare a black paste, which is then applied to, for example, a sheet supporter. Subsequently, the black paste applied onto supporter is semidried to an extent that cohesiveness is exhibited. Together with the supporter, the semidried black paste is transferred only into the shallower groove regions to form the black material layers. For transferring the black paste only into the shallower groove regions, the black paste is contact-bonded at a pressure that enables the black paste to reach only the shallower groove regions but not the deeper groove regions.

In the above constitution, the substrate is preferably light transmissive, and preferably it has a light reflection layer for reflecting lateral light underlying the black material layer. With such a substrate, light produced in a luminous area to approach an adjacent luminous area can be reflected by the light reflection layer for reflecting lateral light underlying the black material layer to proceed to the front substrate, thereby enhancing luminance of a display screen.

Desirably, a light reflection layer for reflecting transmitted light is formed on a surface opposite to the rib-formed surface of the rear substrate. With the light reflection layer for reflecting transmitted light being so formed, light produced in a luminous area to be about to exit from the back side of the rear substrate to the outside can be reflected by the light reflection layer for reflecting transmitted light to proceed to the front substrate, thereby enhancing luminance of the display screen.

The present invention also provides a PDP using the above panel assembly.

The present invention further provides a manufacturing method of the panel assembly for a PDP as described in claim 1, comprising the steps of: forming the ribs on the substrate such that the deeper groove regions to be the luminous areas and the shallower groove regions to be the non-luminous areas are provided between the ribs; applying a black paste onto a flexible supporter with a size corresponding to that of the substrate; causing a surface of the flexible supporter having the black paste to face a surface of the rear substrate having the ribs to contact-bond the flexible supporter to the rear substrate until the black paste reaches bottoms of the shallower groove regions in the grooves between the ribs; and peeling off the flexible supporter from the rib-formed surface of the rear substrate to transfer the black paste only into the shallower groove regions on the rib-formed surface of the rear substrate.

The present invention will now be explained in detail based on the preferred embodiments shown in the drawings. It should be understood that the present invention is not limited to the embodiments but various modifications are possible.

Embodiment 1

FIG. 1 is an explanatory perspective view illustrating the construction of a PDP according to Embodiment 1 of the present invention. The PDP employs a panel assembly according to the present invention. In this example, the PDP is of a linear rib structure. More specifically, it is of a three-electrode surface discharge AC type for color display.

A PDP 10 includes a front panel assembly having a front substrate 11 and a rear panel assembly having a rear substrate 21. As the front substrate 11 and the rear substrate 21, may be used a glass, quartz or ceramic substrate, or the like.

A plurality of pairs of display electrodes X and Y are formed on an internal surface of the front substrate 11 horizontally thereof with non-discharge gaps each provided between the pairs. Each of the display electrodes X and Y comprises a wide transparent electrode 12 made of ITO, $SnO_2$ or the like and a narrow metallic bus electrode 13 made of Ag, Au, Al, Cu or Cr, or of a multi layer of these metals (for example, a multi layer of Cr/Cu/Cr), for example. The display electrodes X and Y can be formed in a desired number, thickness, width and spacing by printing as for Ag and Au and, for the other materials, by combining a deposition method such as vapor deposition or sputtering and etching.

A dielectric layer 17 for AC-driving is formed on the display electrodes X and Y to cover them. Generally, the dielectric layer 17 can be formed by applying a low-melting glass paste onto the front substrate 11 through screen-printing and firing it.

The dielectric layer 17 has on its surface a protective layer 18 for protecting the dielectric layer 17 from being damaged by ion collision which may be caused otherwise by electric discharges at performance of display. The protective layer 18 is formed of MgO, CaO, SrO, BaO or the like.

A plurality of address electrodes A are formed on an internal surface of the rear substrate 21 in a direction intersecting the display electrodes X and Y as viewed in plan. A dielectric layer 24 is formed to cover the address electrodes A. The address electrode A is an electrode for generating a selective discharge (address discharge) to select cells to be lit in an area where the address electrode A intersects the display electrode for scanning. The address electrode A is also made of Ag, Au, Al, Cu or Cr, or a multi layer of these metals (for example, a multi layer of Cr/Cu/Cr), for example. The address electrode A can also be formed in a desired number, thickness, width and spacing by printing as for Ag and Au and, for the other materials, by combining a deposition method such as vapor deposition or sputtering and etching, as is the case of the display electrodes X and Y. The dielectric layer 24 can be formed of the same material and by the same method as used for the dielectric layer 17.

A plurality of ribs 29 each are formed linearly along the address electrodes A on the dielectric layer 24 between the address electrodes A. The ribs 29 can be formed by sand blasting, printing, photoetching or the like. In the sand blasting for example, the ribs 29 are formed by applying a glass paste including a low-melting frit, a binder resin, a solvent and the like onto the dielectric layer 24; drying the glass paste; jetting sand particles thereto via a cutting mask having openings in the same configuration as a rib pattern to remove portions of the glass paste exposed through the openings of the mask; and firing the remaining glass paste. In the photoetching, in place of cutting using the sand particles, a glass paste including a photosensitive resin as the binder resin is used and exposed to light and developed via a mask, followed by firing it, thereby forming the ribs 29.

Phosphor layers 28R, 28G and 28B of red (R), green (G) and blue (B), respectively, are provided on sidewalls of the ribs 29 and on the dielectric layer 24 between the ribs 29. These phosphor layers 28R, 28G and 28B can be formed by repeatedly applying a phosphor paste including a phosphor powder and a binder to the grooves between the ribs 29 through, for example, screen-printing or a method using a dispenser, for each color; and firing the phosphor pastes. Alternatively, the phosphor layers 28R, 28G and 28B may be formed through photolithography using a phosphor layer material sheets (so-called green sheet) including a phosphor powder and a binder. In this case, the phosphor layer of each color can be formed in the grooves between the ribs corresponding to the colors by bonding the sheet of a desired color to the substrate over the entire display area; exposing to light and developing it; and repeating these bonding as well as exposing and development processes.

The PDP 10 is produced by disposing the front and rear panel assemblies in an opposing relation such that the display electrodes X and Y intersect the address electrodes A; sealing the periphery; and filling a discharge gas within discharge spaces 30 each defined by the ribs 29. In this PDP 10, the discharge space 30 where the display electrodes X and Y as a pair and the address electrode A intersect is a single cell area (unit luminous area) as a minimum display unit. One pixel is made up by adjacent three cells in R, G and B.

Display is performed as follows. First, using the display electrode Y used as a scan electrode, a scan voltage is sequentially applied to the display electrodes Y, while an address voltage is applied to a desired address electrode A to generate an address discharge between the selected address electrode A and display electrode Y for selecting a cell to be lit where a wall charge is produced on the dielectric layer 17. Next, a sustain voltage is alternately applied to the display electrode X and to the display electrode Y to generate further electric discharges (also referred to as sustain discharges or display discharges) in the cell where the wall charge is accumulated, thereby lighting the cell. For lighting the cell, ultraviolet light generated during the display discharges excites phosphor in the cell and causes it to emit visible light of a desired color.

The display is executed by generating sustain discharges between the display electrodes X and Y as a pair (hereafter referred to as a pair of display electrodes X and Y), as mentioned above. The gap between the pair of display electrode pairs X and Y, which also called emission slit, is to serve as a luminous area, whereas a gap between the pairs of display electrodes X and Y, which is called non-emission slit, is to serve as a non-luminous area.

Figure 2:
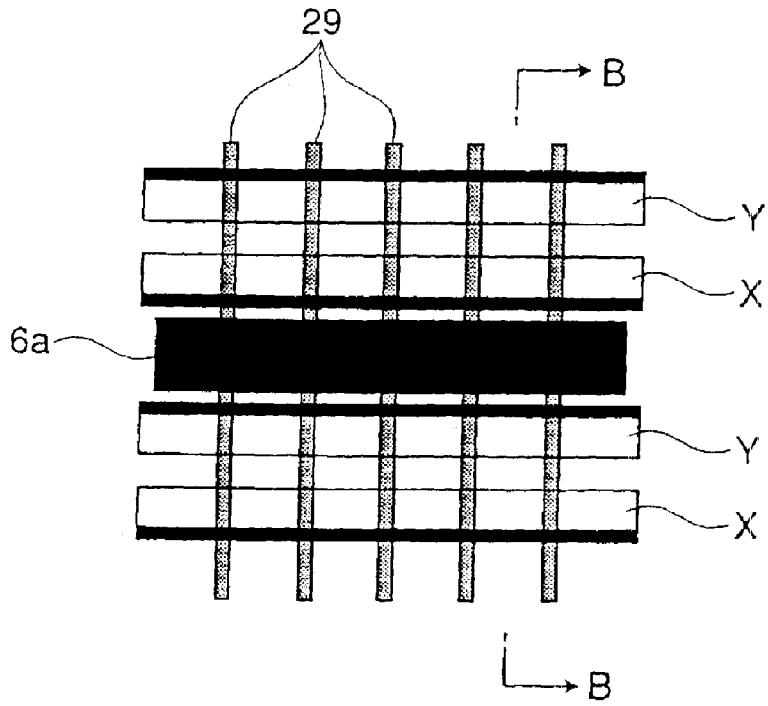
FIG. 2 is an explanatory view illustrating the PDP of FIG. 1 in plan.
Figure 3:
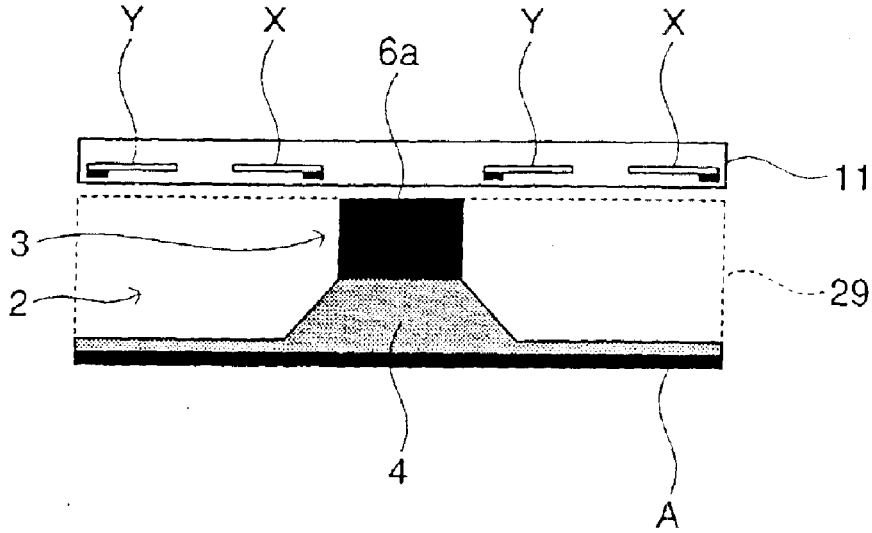
FIG. 3 is an explanatory view illustrating a cross-sectional view of the PDP taken on line B—B of FIG. 2.

FIGS. 2 and 3 are explanatory views illustrating a detailed portion of the PDP of FIG. 1. FIG. 2 is an explanatory view illustrating the PDP of FIG. 1 in plan, and FIG. 3 is an explanatory view illustrating a cross-sectional view of the PDP taken on line B—B of FIG. 2.

As seen in these drawings, black pigment layers 6*a* are provided in the non-luminous areas between the pairs of display electrodes X and Y.

The black pigment layers 6*a* are provided in the non-luminous areas as follows. The ribs 29 are formed by digging grooves on both sides of the rib 29. In that case, deeper groove regions 2 are formed in areas of the groove corresponding to the luminous areas, and shallower groove regions 3 are formed in areas of the groove corresponding to the non-luminous areas. This means that the deeper groove regions 2 are formed at a depth of 100 to 150 $\mu$m and the shallower groove regions 3 are formed at a depth of 50 to 75 $\mu$m in the groove when the grooves are dug by sand blasting. In other words, projections 4 are formed when the grooves are dug. Then, by a method to be mentioned later, the black pigment layers 6*a* are formed only in the shallower groove regions 3, i.e., only on the projections 4 at the tops, so that the black pigment layers 6*a* are formed in the non-luminous areas.

As a black pigment to be used for the black pigment layer 6*a*, is used a black pigment of a chromium oxide, a copper oxide or the like with an average particle diameter of 2 to 3 $\mu$m. As an example of the chromium oxide, may be used $Cr_2O_3$ or the like.

Thus, forming the black pigment layers 6*a* in the non-luminous areas can improve the contrast in display of the PDP.

Figure 4:
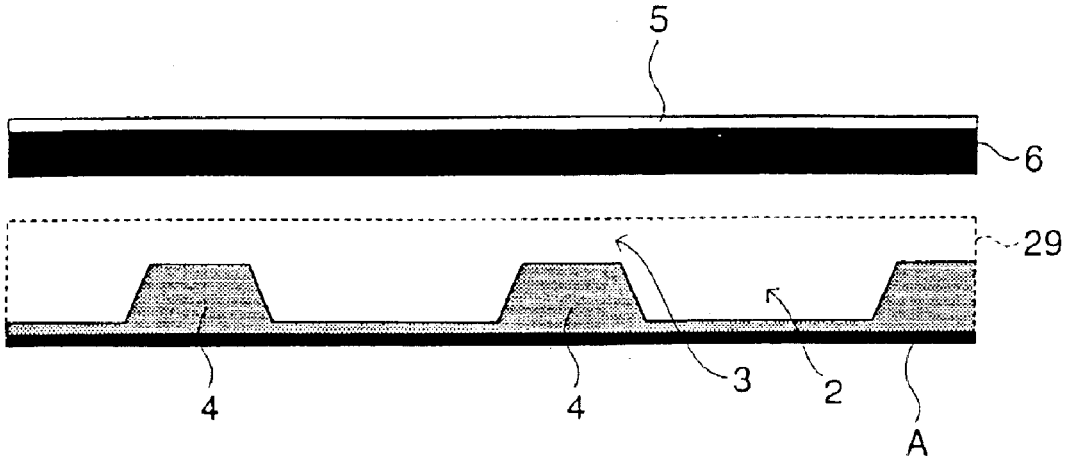
FIGS. 4(*a*), 4(*b*) and 4(*c*) are explanatory views illustrating a method of forming black pigment layers in non-luminous areas.
Figure 4:
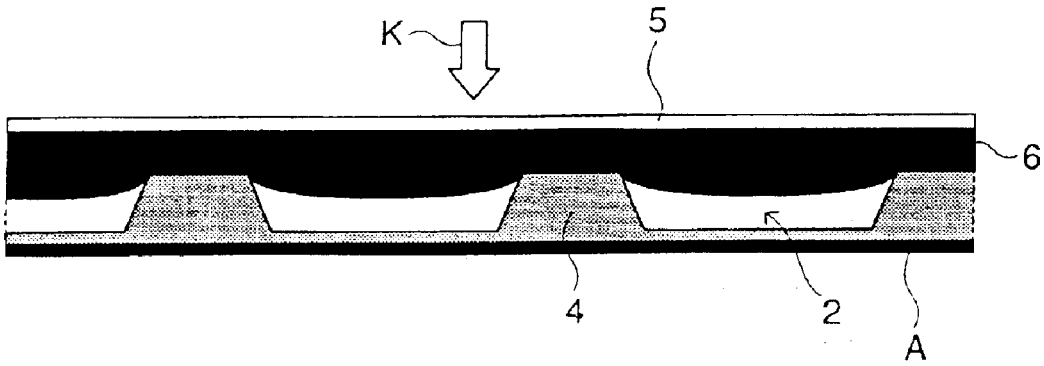
Figure 4:
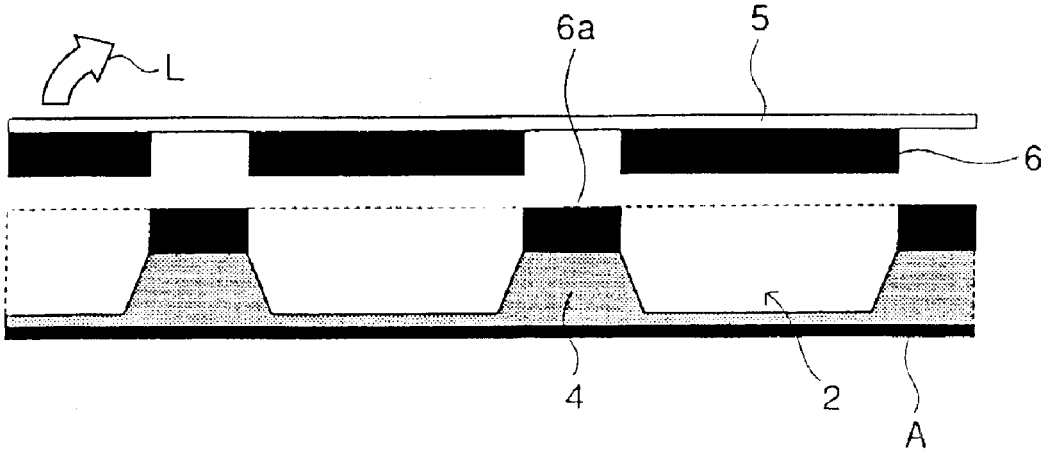

FIGS. 4(*a*), 4(*b*) and 4(*c*) are explanatory views illustrating a method of forming the black pigment layers 6*a* in the non-luminous areas.

For forming the black pigment layers 6*a* in the non-luminous areas, first, a black paste 6 is prepared by adding a binder resin and an organic solvent to the black pigment. As the binder resin, is used an acrylic resin, ethyl cellulose or the like. As the organic solvent, is used terpineol, BCA or the like.

Next, the black paste 6 is adjusted to a viscosity of about 100 to 200 Pa·S. Using a slot coater or a screen-printing technique, the black paste 6 is applied onto a supporter 5. The supporter 5 is made either of a flexible sheet with a size corresponding to that of the rear substrate or of a rigid plate to which silicone rubber having a hardness of less than 1 is bonded so that the rigid plate has a thickness of about 2 mm. The supporter 5 is then semidried in a drying chamber at 80 to 100° C. for about 15 minutes to an extent that cohesiveness is exhibited.

Next, a surface of the supporter 5 having the black paste 6 is caused to face a surface of the rear substrate having the ribs (see FIG. 4(*a*)); the supporter 5 is contact-bonded to the rear substrate as indicated by arrow K until the black paste 6 reaches bottoms of the shallower groove regions 3 in the grooves between the ribs (see FIG. 4(*b*)); it is peeled off from the rib-formed surface of the rear substrate as indicated by arrow L to transfer the black paste 6 only into the shallower groove regions 3, i.e., only onto the projections 4 at the tops on the rib-formed surface of the rear substrate (see FIG. 4(*c*)); and the black paste 6 thus transferred is dried. Thus, the black pigment layers 6*a* are formed in the non-luminous areas When the supporter 5 is contact-bonded to the rear substrate, the black paste 6 reaches the shallower groove regions 3, i.e., the projections 4 at the tops, but it does not contact the bottoms of the deeper groove regions 2 in the grooves. Therefore, the cohesive black paste 6 is left only on the projections 4 at the tops, thereby eliminating the need for strict alignment between the front and rear substrates. This makes it possible to form the black pigment layers 6*a* only in the shallower groove regions 3, i.e., only in the non-luminous areas, in a self-aligning manner.

In a process prior to the formation of the black pigment layer 6, the phosphor layers are formed in the grooves between the ribs.

Embodiment 2

Figure 5:
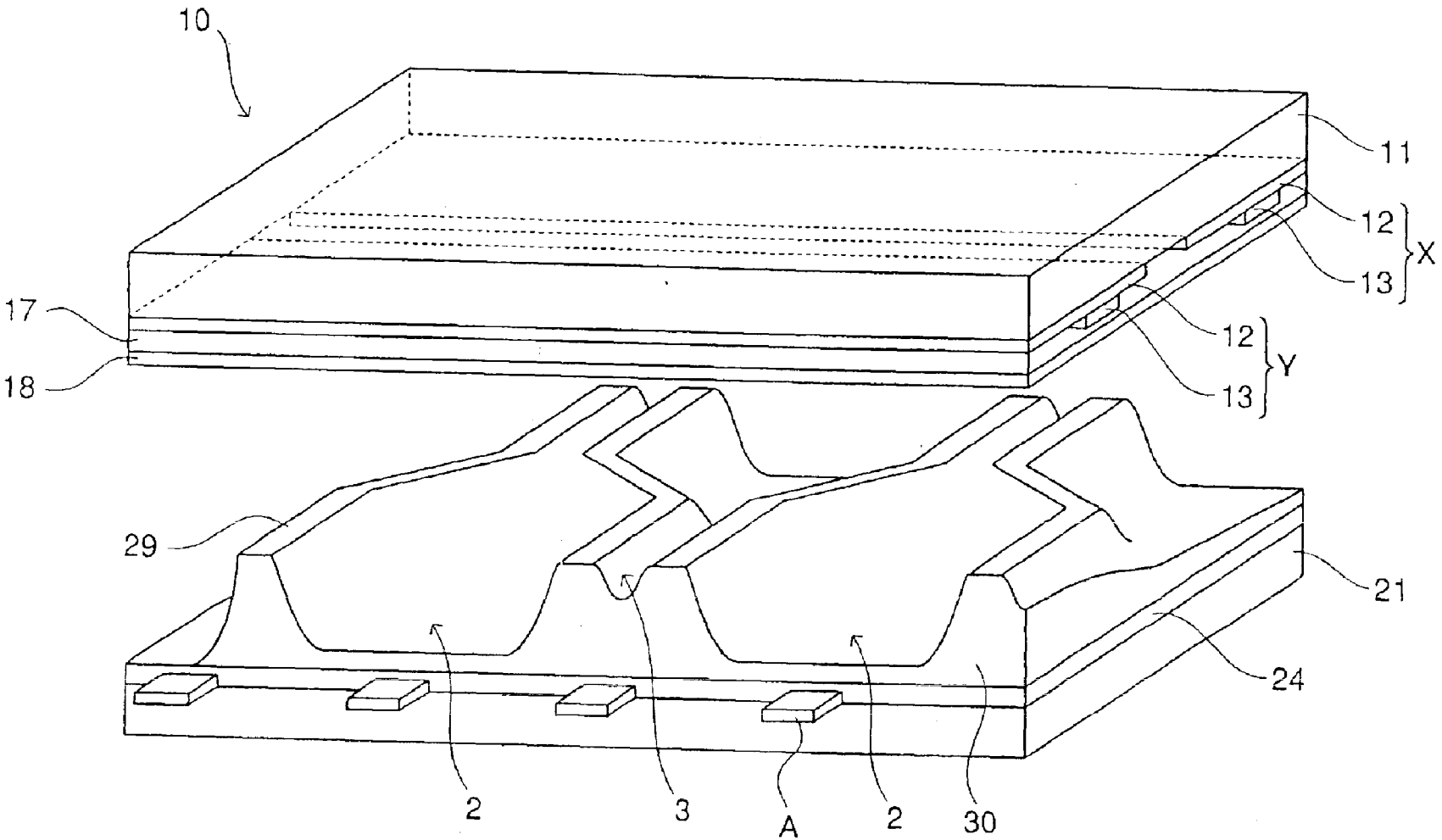
FIG. 5 is an explanatory perspective view illustrating the construction of a PDP according to Embodiment 2 of the present invention.

FIG. 5 is an explanatory perspective view illustrating the construction of a PDP according to Embodiment 2 of the present invention. The PDP employs panel assemblies according to the present invention. In this example, the PDP is of a meander rib structure. More specifically, it is of a three-electrode surface discharge AC type for color display, as is the PDP of FIG. 1.

The features of the PDP having a meander rib structure according to the present invention are that the ribs 29 each have a meander configuration and that electric discharges can be generated between each display electrode and an display electrode adjacently located on either side of said each electrode. The address electrodes A are each formed linearly in the grooves between the ribs, as is the case of the PDP of FIG. 1.

In other words, the groove is open continuously in a longitudinal direction and defined between the ribs each having the meander configuration, so that wider groove regions and narrower groove regions are formed alternately in the grooves. The display electrodes X and Y are disposed parallel to each other so as to generate electric discharges in the wider groove regions, whereby the wider groove regions are to serve as the luminous areas and the narrower groove regions are to serve as the non-luminous areas. Also, the deeper groove regions 2 are formed in the wider groove areas that are to be the luminous areas, and the shallower groove regions 3 are formed in the narrower groove regions that are to be the non-luminous areas. The black paste is transferred into the shallower groove regions 3 to form the black pigment layers in the non-luminous areas.

In this example, the ribs 29 are formed through sand blasting by providing the rib material layer on the substrate over the entire rib-formed surface; jetting sand particles onto the rib material layer via a mask having openings in the same configuration as a rib pattern to remove portions of the rib material layer with cutting rates different between the wider groove region and the narrower groove region, thereby delaying the cutting for the narrower groove region compared with that for the other region. By utilizing this property, it is possible automatically to cause the narrower groove regions that are to be the non-luminous areas to become the shallower groove regions.

Figure 6:
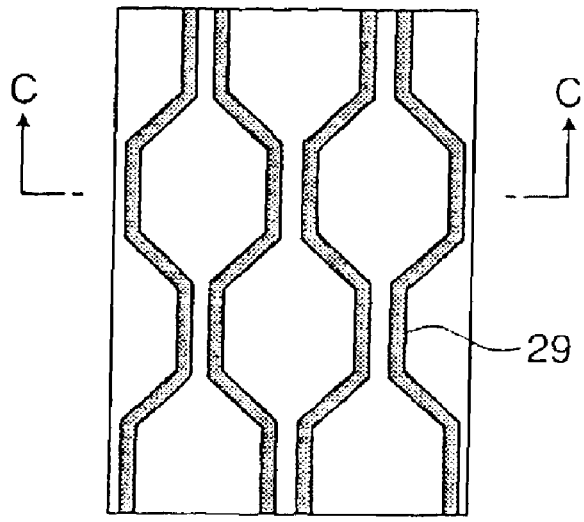
FIG. 6 is a plan view showing a rear panel assembly in the PDP of FIG. 5.
Figure 7:
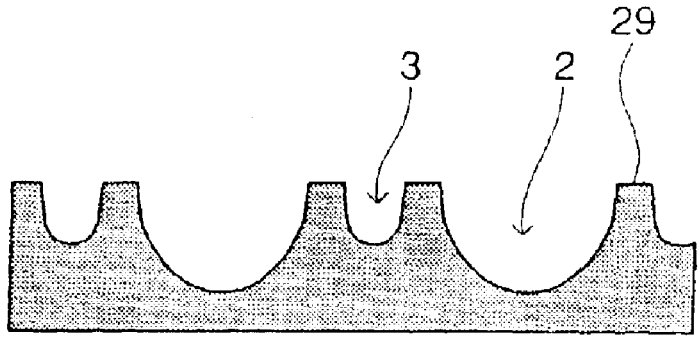
FIG. 7 is a cross-sectional view of the PDP taken on line C—C of FIG. 6.

FIGS. 6 and 7 are explanatory views illustrating a rear panel assembly in the PDP of FIG. 5. FIG. 6 is a plan view showing the rear panel assembly, and FIG. 7 is a cross-sectional view of the PDP taken on line C—C of FIG. 6. In the following examples, the ribs are formed on a plane glass substrate of a thickness of 2 to 3 mm by digging the grooves directly in the substrate.

As shown in these drawings, the deeper groove regions 2 where the grooves are 100 to 150 $\mu$m deep are formed in the wider groove regions that are to be the luminous areas and the shallower groove regions 3 where the grooves are 50 to 75 $\mu$m deep are formed in the narrower groove regions that are to be the non-luminous areas. In the glass substrate of FIG. 7, the deeper groove region 2 has a width of about 300 $\mu$m and the shallower groove region 3 has a width of about 70 $\mu$m.

Figure 8:
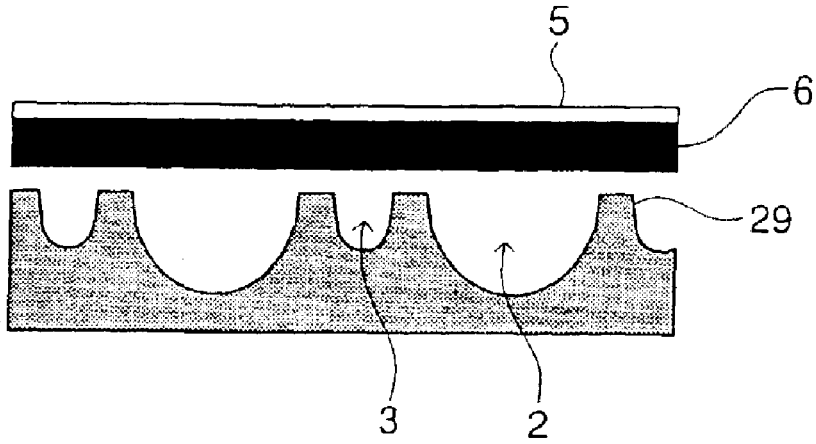
FIGS. 8(*a*), 8(*b*) and 8(*c*) are explanatory views illustrating a method of forming the black pigment layers in the non-luminous areas on the rear panel assembly.
Figure 8:
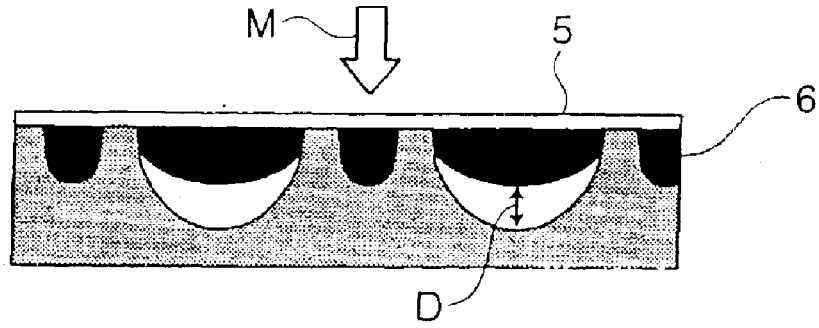
Figure 8:
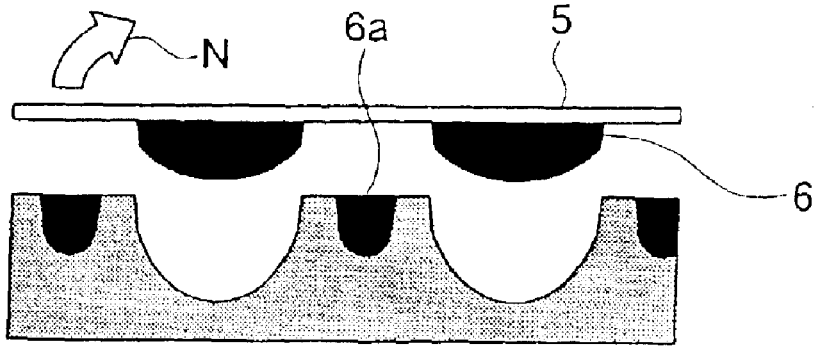

FIGS. 8(*a*), 8(*b*) and 8(*c*) are explanatory views illustrating a method of forming the black pigment layers in the non-luminous areas on the rear panel assembly.

This method is fundamentally the same as the method of FIG. 4. First, the same black paste 6 as used in the method of FIG. 4 is applied onto the supporter 5 and semidried to an extent that cohesiveness is exhibited.

Next, the black paste-applied surface of the supporter 5 is caused to face the rib-formed surface of the rear substrate (see FIG. 8(*a*)); and the supporter 5 is contact-bonded to the rear substrate as indicated by arrow M until the black paste 6 reaches the bottoms of the shallower groove regions 3 in the grooves between the ribs (see FIG. 8(*b*)). Here, clearances D are provided between the bottoms of the deeper groove regions 2 and the black paste 6.

Then, the supporter 5 is peeled off from the rib-formed surface of the rear substrate as indicated by arrow N to transfer the black paste 6 only into the shallower groove regions 3 on the rib-formed surface of the rear substrate (see FIG. 8(*c*)). This makes it possible to form the black pigment layers 6*a* only in the shallower groove regions 3, i.e., only in the non-luminous areas, in a self-aligning manner.

Figure 9:
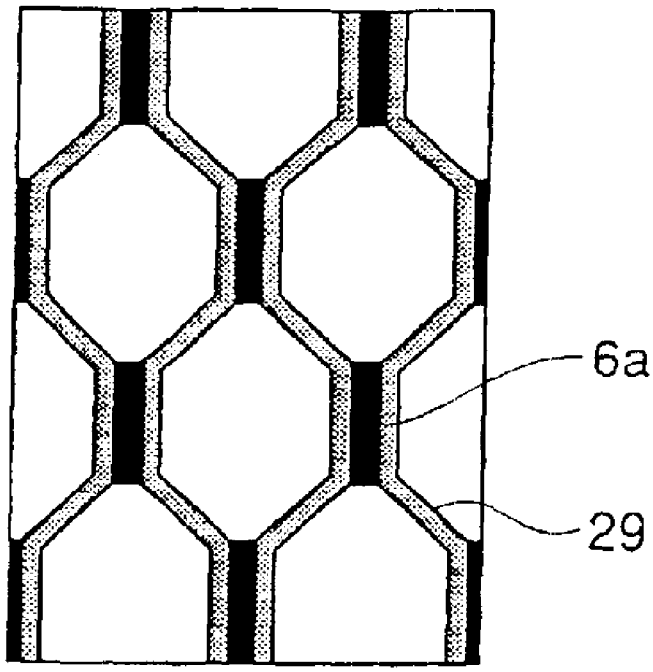
FIG. 9 is a plan view illustrating the rear panel assembly in which the black pigment layers are formed in the non-luminous areas.

FIG. 9 is a plan view illustrating the rear panel assembly in which the black pigment layers are formed in the non-luminous areas. As seen in this drawing, the black pigment layers 6*a* are formed by the above-mentioned method only in the narrower groove regions that are to be the non-luminous areas.

In a process prior to the formation of the black pigment layer 6, the address electrode and the phosphor layer are sequentially provided in the groove between the ribs.

Figure 10:
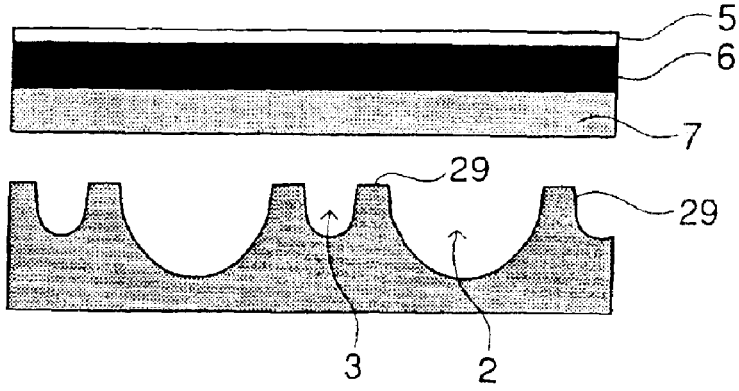
FIGS. 10(*a*) to 10(*d*) are explanatory views illustrating a method of forming the black pigment layers and white pigment layers in the non-luminous areas of the rear panel assembly.
Figure 10B:
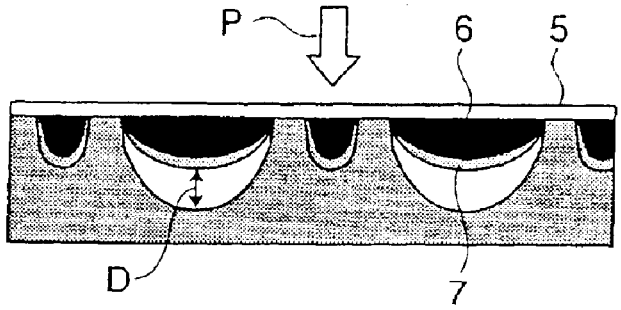
Figure 10:
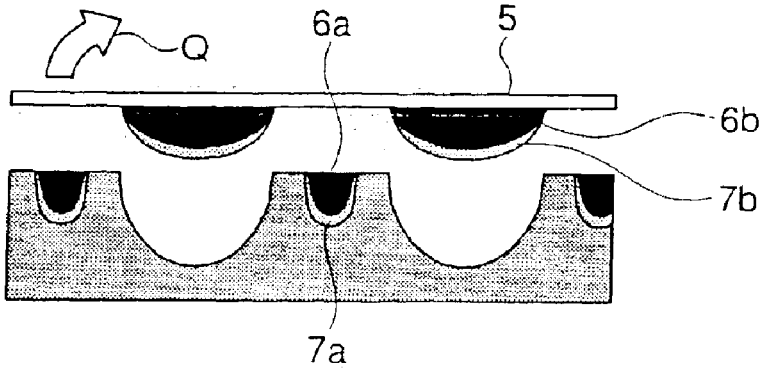
Figure 10:
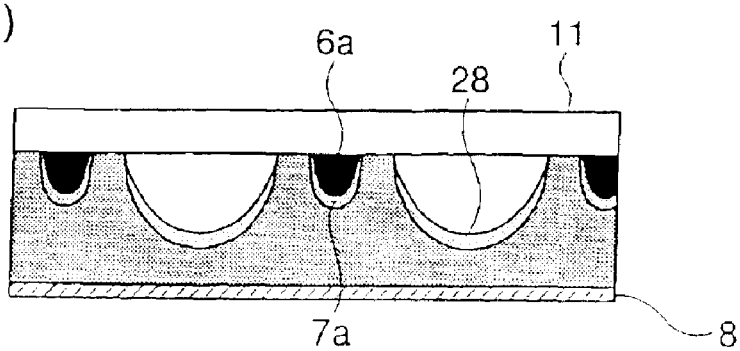

FIGS. 10(*a*) to 10(*d*) are explanatory views illustrating a method of forming the black pigment layers and the white pigment layers in the non-luminous areas of the rear panel assembly.

This method is the same as the method of FIG. 8, except that the black paste 6 which is to form a light absorption layer and a white paste 7 which is to form a light reflection layer are applied onto the supporter 5. The white paste 7 is a paste to form a white pigment layer and prepared by adding a binder resin and an organic solvent to a white pigment. As the white pigment, may be employed a titanium oxide of an average particle diameter of 2 to 3 $\mu$m or the like. As the titanium oxide, may be employed $TiO_2$ or the like.

The method is the same as the method of FIG. 8 except for the above. First, the black paste 6 and the white paste 7 are applied onto the supporter 5 and semidried to an extent that cohesiveness is exhibited.

Next, the black paste-applied surface of the supporter 5 is caused to face the rib-formed surface of the rear substrate (see FIG. 10(*a*)); and the supporter 5 is contact-bonded to the rear substrate as indicated by arrow P until the black paste 6 reaches the bottoms of the shallower groove regions 3 in the grooves between the ribs (see FIG. 10(*b*)). Here, the clearances D are provided between the bottoms of the deeper groove regions 2 and the white paste 7.

Then, the supporter 5 is peeled off from the rib-formed surface of the rear substrate as indicated by arrow Q to transfer the black paste 6 and the white paste 7 only into the shallower groove regions 3 on the rib-formed surface of the rear substrate, and the black paste 6 thus transferred is dried to form the black pigment layers 6*a* in the non-luminous areas (see FIG. 10(*c*)). This makes it possible to form the black pigment layers 6*a* and the white pigment layers 7*a* only in the shallower groove regions 3, i.e., only in the non-luminous areas, in a self-aligning manner. The white pigment layer 7*a* is to serve as a light reflection layer for reflecting lateral light.

Subsequently, the phosphor layers 28 are formed in the deeper groove regions 2; the front panel assembly having the front substrate 11 are aligned with the rear panel assembly to dispose them in an opposing relation; and the periphery is sealed to produce the PDP. Finally, a light reflection layer 8 for reflecting transmitted light is formed on a back surface of the rear substrate. For the formation of the light reflection layer 8, an aluminum foil or an aluminum plate is bonded to the back surface of the rear substrate. Alternatively, aluminum may beforehand be deposited on the back surface of the rear substrate. Owing to the presence of the light reflection layer 8, the following effects can be obtained.

Figure 11:
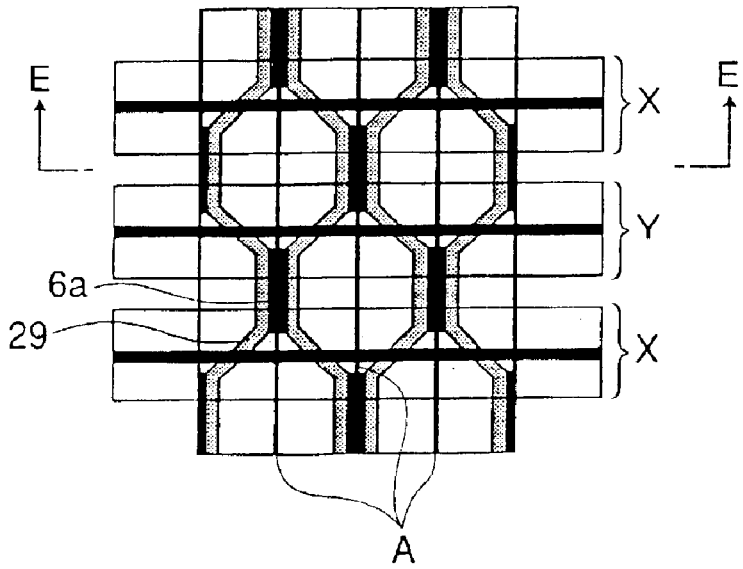
FIG. 11 is a plan view illustrating the rear panel assembly having the black pigment layers and the white pigment layers formed in the non-luminous areas.
Figure 12:
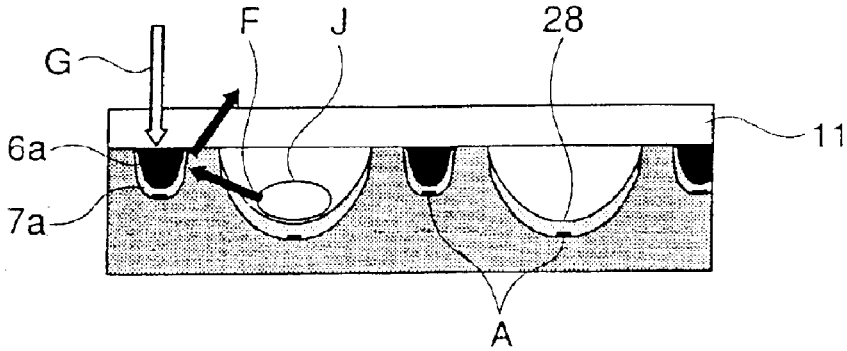
FIG. 12 is a cross-sectional view of the PDP taken on line E—E of FIG. 11.
Figure 13:
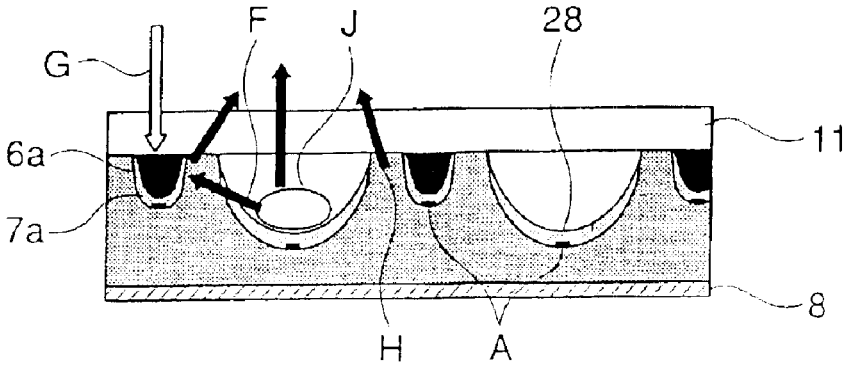
FIG. 13 is a cross-sectional view of the PDP taken on line E—E of FIG. 11.

FIG. 11 is a plan view illustrating the rear panel assembly having the black pigment layers and the white pigment layers formed on the non-luminous areas. FIGS. 12 and 13 are cross-sectional views of the PDP taken on line E—E of FIG. 11. FIGS. 12 and 13 show the address electrode and the phosphor layer 28 formed in a process prior to the formation of the black pigment layer and white pigment layer.

FIG. 12 shows a state in which the black pigment layers 6*a* and the white pigment layers 7*a* are formed in the non-luminous areas. As seen, since the black pigment layers 6*a* and the white pigment layers 7*a* are formed in the non-luminous areas, Light G incident from the front substrate 11 on the black pigment layers 6*a* is absorbed into the black pigment layers 6*a* without being reflected. Further, among light produced by Electric Discharge J generated in the luminous area, Light F emitted laterally is reflected by the white pigment layer 7*a* that is to serve as the light reflection layer for reflecting lateral light, and emitted forwards. As a result, the contrast in display and luminance of the PDP can be improved.

FIG. 13 is a view illustrating a state in which the black pigment layers 6*a* and the white pigment layers 7*a* are formed in the non-luminous areas and in which the light reflection layer 8 for reflecting transmitted light is formed on the back surface of the rear substrate. As seen, since the light reflection layer 8 for reflecting transmitted light is formed on the back surface of the rear substrate, a further behavior of light is exhibited as follows: among light produced by Electric Discharge J generated in the luminous area, Light H that is about to be transmitted backwards is reflected by the light reflection layer 8 for reflecting transmitted light, and emitted forwards. As a result, luminance of the PDP can be further improved.

Figure 14:
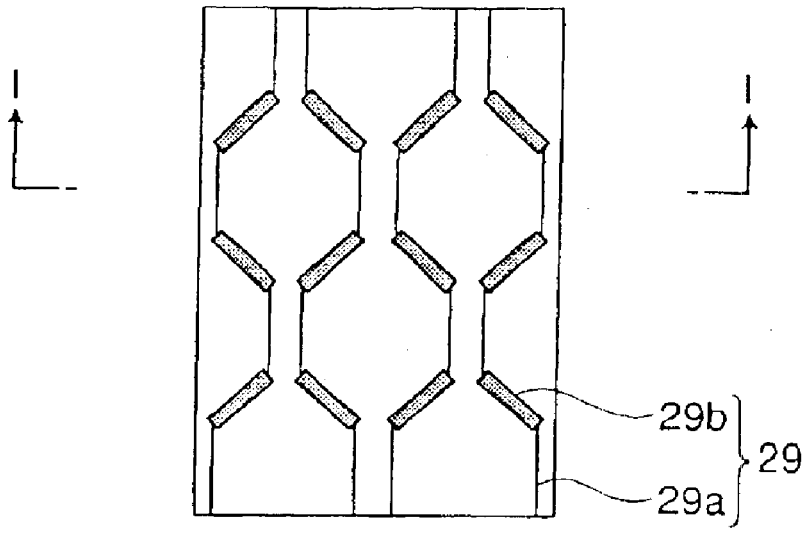
FIG. 14 is a plan view of the rear panel assembly where rib tops are narrowed.
Figure 15:
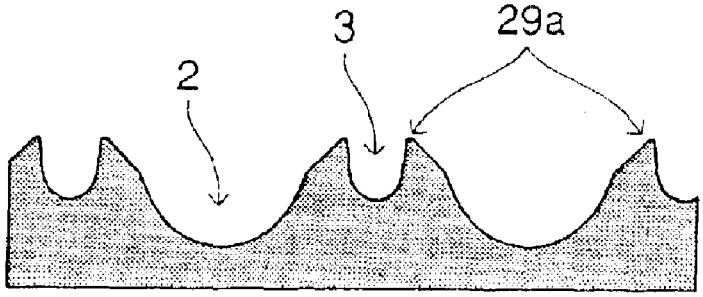
FIG. 15 is a cross-sectional view taken on line I—I of FIG. 14.

FIGS. 14 and 15 are explanatory view illustrating an example where rib tops are narrowed. FIG. 14 is a plan view of the rear panel assembly, and FIG. 15 is a cross-sectional view taken on line I—I of FIG. 14.

As seen in these drawing, each rib top 29*a* where the rib 29 partitions adjacent deeper groove region 2 to be the non-luminous area and shallower groove region 3 to be the luminous area is narrowed compared with each rib top 29*b* where the rib 29 partitions adjacent deeper groove regions 2. The rib tops 29*a* each have the configuration of a knife-edge in cross section, which provides a merit as below.

Figure 16:
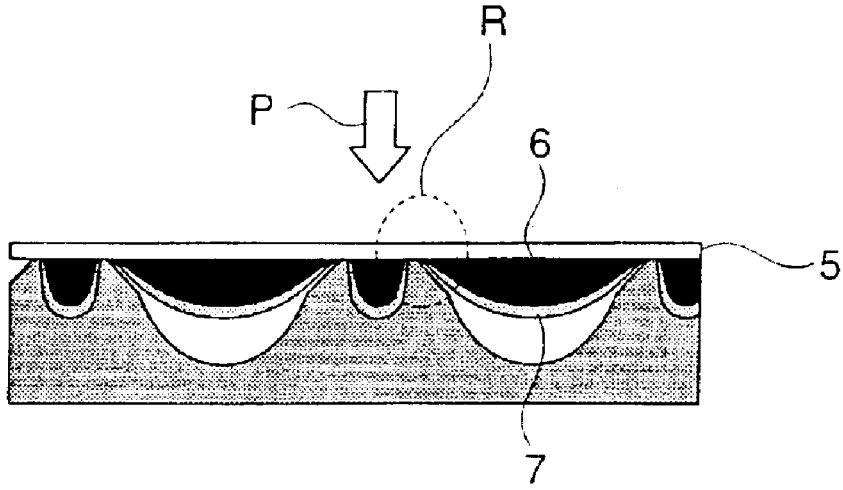
FIGS. 16(*a*) and 16(*b*) are explanatory views illustrating a method of forming the black pigment layers and the white pigment layers in the non-luminous areas of the rear panel assembly in which the rib tops are narrowed.
Figure 16:
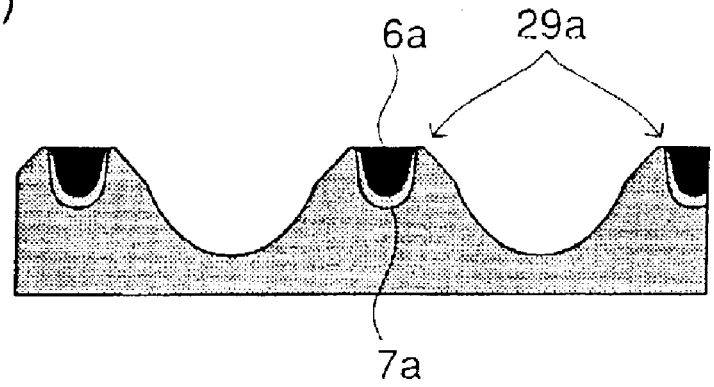

FIGS. 16(*a*) and 16(*b*) are explanatory views illustrating a method of forming the black pigment layers and the white pigment layers in the non-luminous areas of the rear panel assembly in which the rib tops are narrowed.

This method is fundamentally the same as the method of FIG. 10. In this example as well, the black paste 6 to form the light absorption layer and the white paste 7 to form the light reflection layer are applied onto the supporter 5.

The rib tops 29*a* function like a knife edge since they are narrowed (see the area indicated by R) (see FIG. 16(*a*)), and separate the black paste 6 from the white paste 7 applied onto the supporter 5, thereby improving accuracy in transferring the black paste 6 and the white paste 7 into the non-luminous areas.

Then, the supporter 5 is peeled off from the rib-formed surface of the rear substrate to transfer the black paste 6 and the white paste 7 only into the shallower groove regions on the rib-formed surface of the rear substrate; the black paste 6 and the white paste 7 thus transferred are dried, thereby forming the black paste 6 and the white paste 7 in the non-luminous areas (see FIG. 16(*b*)).

Thus, producing the PDP by forming the black material layers in the shallower groove regions to be the non-luminous areas of the rear panel assembly can improve the contrast in display of the PDP since the black material layers absorb external light. Further, forming the black material layers in the rear panel assembly eliminates the need for strict alignment between the front and rear substrates.

Also, for forming the black material layers in the shallower groove regions to be the non-luminous areas, the black paste is contact-bonded to and transferred into the rear panel assembly, so that the supporter is contact-bonded to the rear substrate until the black paste reaches the bottoms of the shallower groove regions in the grooves. This makes it possible to form the black pigment layers only in the shallower groove regions to be the non-luminous areas, in a self-aligning manner.

According to the present invention, the black material layers are formed in the shallower groove regions to be the non-luminous areas on the substrate. Therefore, when the substrate is used as, for example, a rear substrate and opposed to a front substrate for producing a PDP, the black material layers can absorb external light to thereby improve the contrast in display of the PDP. Further, the black material layers exist in the non-luminous areas themselves to eliminate the need for strict alignment between the front and rear substrates, which may possibly arise if the black material layers are formed on the front substrate for example.

What is claimed is:

1. A panel assembly for a PDP having ribs or partitioning a discharge space on a substrate, comprising:

grooves each formed between adjacent ribs, each of the grooves having deeper groove regions to be luminous areas and shallower groove regions to be non-luminous areas; and black material layers formed on the shallower groove regions.

2. The panel assembly of claim 1, wherein the ribs each have a meander configuration such that wider groove regions corresponding to the deeper groove regions and narrower groove regions corresponding to the shallower groove regions are formed alternately in the grooves between the ribs.

3. The panel assembly of claim 1, wherein the substrate is a plane substrate in which the ribs are formed by digging the grooves.

4. The panel assembly of claim 1, wherein the substrate is a light transmissive substrate in which a light reflection layer for reflecting lateral light underlies the black material layer.

5. The panel assembly of claim 4, further comprising a light reflection layer formed on a surface opposite to the rib forming surface of the substrate, for reflecting transmitted light.

6. A panel assembly for a PDP, comprising:

a substrate; and a recess to be a discharge space formed on the substrate, the recess having deeper recess regions to be luminous areas and shallower recess regions to be non luminous areas, the shallower recess regions having black material layers, respectively.

7. A PDP using the panel assembly as described in claim 1.

8. A manufacturing method of the panel assembly as described in claim 1, comprising the steps of:

forming the ribs on the substrate such that the deeper groove regions to be the luminous areas and the shallower groove regions to be the non-luminous areas are provided between the ribs;

applying a black paste onto a flexible supporter with a size corresponding to that of the substrate;

causing a surface of the flexible supporter having the black paste to face a surface of the substrate having the ribs to contact-bond the flexible supporter to the substrate until the black paste reaches the bottoms of the shallower groove regions in the grooves between the ribs; and peeling off the flexible supporter from the rib-formed surface of the substrate to transfer the black paste only into the shallower groove regions on the rib-formed surface of the substrate.

9. A PDP using The panel assembly as described in claim 6.

* * * * *